US006412293B1

(12) United States Patent
Pham et al.

(10) Patent No.: US 6,412,293 B1
(45) Date of Patent: Jul. 2, 2002

(54) SCROLL MACHINE WITH CONTINUOUS CAPACITY MODULATION

(75) Inventors: Hung M. Pham; Jean-Luc Caillat, both of Dayton, OH (US)

(73) Assignee: Copeland Corporation, Sidney, OH (US)

( * ) Notice: Subject to any disclaimer, the term of this patent is extended or adjusted under 35 U.S.C. 154(b) by 35 days.

(21) Appl. No.: 09/686,561

(22) Filed: Oct. 11, 2000

(51) Int. Cl.[7] ..... F25B 49/00

(52) U.S. Cl. ..... 62/228.3; 62/228.1; 62/228.5; 62/157; 62/196.3; 236/46 R; 417/14; 417/213

(58) Field of Search ..... 62/228.1, 228.3, 62/228.5, 228.4, 196.3, 157; 236/46 R; 417/213, 212, 14, 18, 32, 44.1

(56) References Cited

U.S. PATENT DOCUMENTS

| | | | | |
|---|---|---|---|---|
| 4,383,805 A | | 5/1983 | Teegarden et al. | |
| 4,441,863 A | | 4/1984 | Hotta et al. | |
| 4,456,435 A | | 6/1984 | Hiraga et al. | |
| 4,468,178 A | | 8/1984 | Hiraga et al. | |
| 4,497,615 A | | 2/1985 | Griffith | |
| 4,514,150 A | | 4/1985 | Hiraga et al. | |
| 4,566,863 A | | 1/1986 | Goto et al. | |
| 4,673,340 A | | 6/1987 | Mabe et al. | |
| 4,747,756 A | | 5/1988 | Sato et al. | |
| 4,767,293 A | | 8/1988 | Caillat et al. | |
| 4,846,633 A | | 7/1989 | Suzuki et al. | |
| 4,877,382 A | | 10/1989 | Caillat et al. | |
| 4,992,033 A | | 2/1991 | Caillat et al. | |
| 5,074,760 A | | 12/1991 | Hirooka et al. | |
| 5,074,761 A | | 12/1991 | Hirooka et al. | |
| 5,102,316 A | | 4/1992 | Caillat et al. | |
| 5,983,658 A | * | 11/1999 | Kelm et al. | 62/228.5 |
| 6,047,557 A | * | 4/2000 | Pham et al. | 62/228.5 |
| 6,089,034 A | * | 7/2000 | Lake et al. | 62/204 |
| 6,120,255 A | | 9/2000 | Schumann et al. | |
| 6,206,652 B1 | * | 3/2001 | Caillat | 417/298 |
| 6,213,731 B1 | * | 4/2001 | Doepker et al. | 417/310 |

* cited by examiner

*Primary Examiner*—Denise L. Esquivel
*Assistant Examiner*—Marc Norman
(74) *Attorney, Agent, or Firm*—Harness, Dickey & Pierce, P.L.C.

(57) ABSTRACT

An improved continuous capacity modulation system for scroll-type compressors is disclosed in which a valve body of a solenoid valve assembly is secured to the inner wall of the hermetic shell and the actuating coil is mounted on the outer surface thereof. The actuating coil includes a plunger/valve member which cooperates with passages provided in the valve body to selectively actuate the capacity modulation arrangement utilizing compressed fluid. The construction offers the advantage that all fluid pressure lines are located within the hermetic shell and thus protected from potential damage, the solenoid coil may be easily changed/replaced to accommodate different available operating voltages and/or malfunction thereof and the system can be easily tested prior to final welding of the outer shell. The actuating coil is controlled by Pulse Width Modulation to reduce the load demand of the compressor during times when load shedding is required.

53 Claims, 8 Drawing Sheets

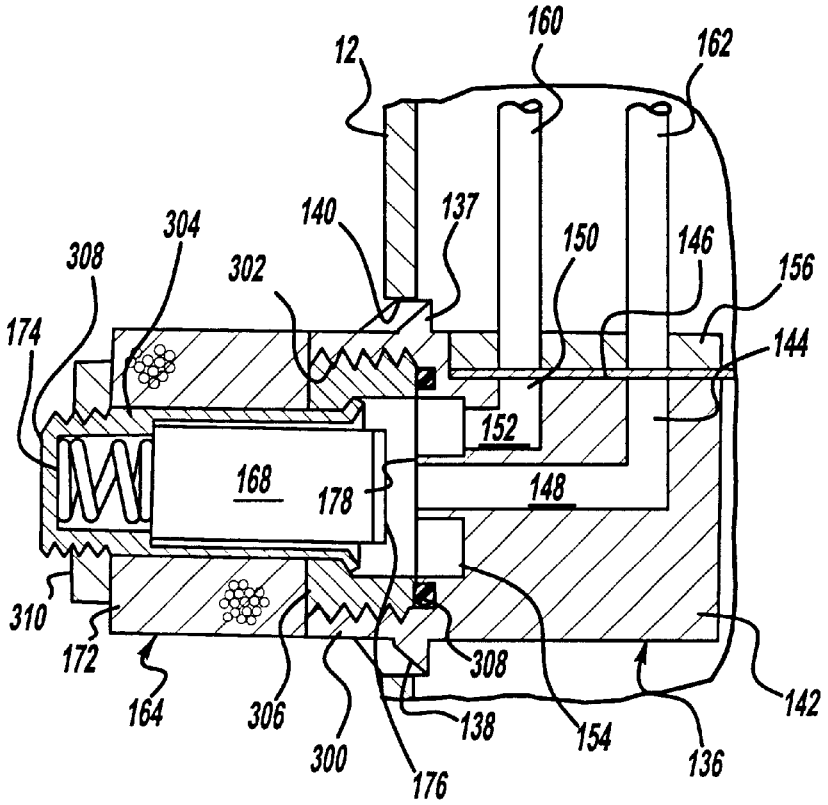
Figure - 12
Figure - 13
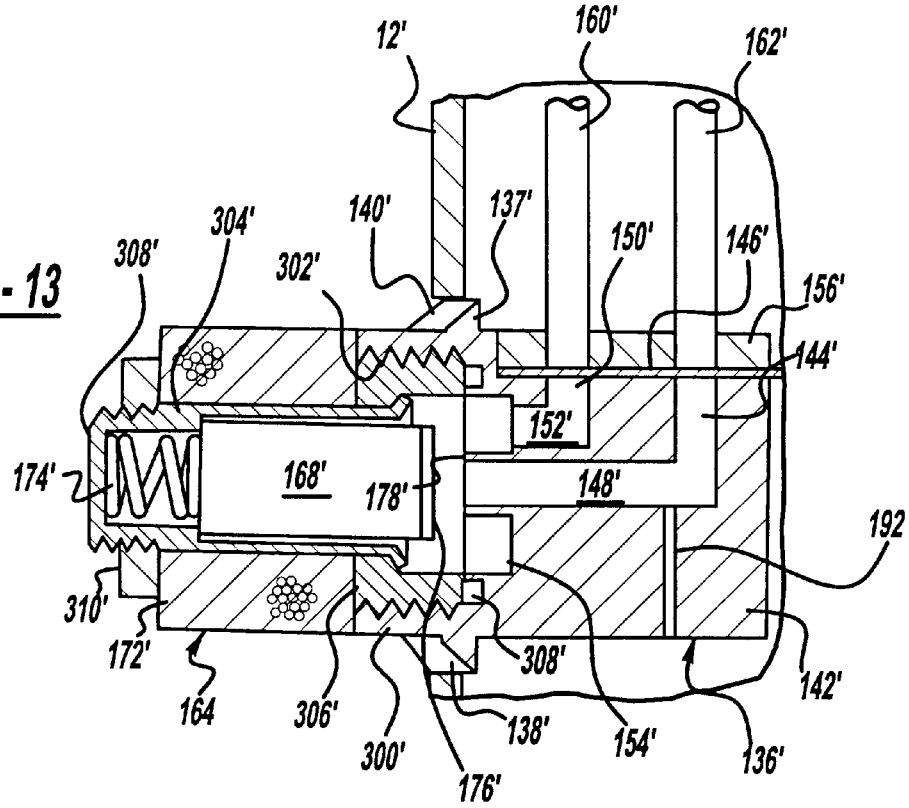

SCROLL MACHINE WITH CONTINUOUS CAPACITY MODULATION

FIELD OF THE INVENTION

The present invention relates generally to scroll compressors and more specifically to continuous capacity modulation systems of the delayed suction type for such compressors.

Utility summer peak demand limit control has historically been the driving demand behind the need for load shedding for refrigeration compressors. The traditional method used for load shedding has been to have the room thermostat perform an on/off duty cycle of the air conditioning system on the order of every 15 minutes. The disadvantages to this method are that the control and communication hardware cost to implement this system is higher than the savings from demand-side management, and the comfort provided by the system is diminished with long off cycles. Another approach that utilities are using is variable speed air conditioning systems that can modulate capacity and power continuously down to about 75%–80% of capacity. However, not only are variable speed inverters expensive, they also reduce power supply quality through harmonics, thus defeating the utilities original interest. A two-step compressor using a two-speed or a reversing motor is another option, but these systems have limited capability because the motor has to be shut down for 1–2 minutes between speed changes to assure reliability. One possibility to accomplish this load shedding is to utilize a capacity modulated compressor.

A wide variety of systems have been developed in order to accomplish capacity modulation for refrigerant compressors, most of which delay the initial sealing point of the moving fluid pockets defined by the scroll members. In one form, such systems commonly employ a pair of vent passages communicating between suction pressure and the outermost pair of moving fluid pockets. Typically these passages open into the moving fluid pockets at a position within 360° of the sealing point of the outer ends of the wraps. Some systems employ a separate valve member for each of these vent passages. The valve members are intended to be operated simultaneously so as to ensure a pressure balance between the two fluid pockets. Other systems employ additional passages to place the two vent passages in fluid communication, thereby enabling use of a single valve to control capacity modulation.

Most recently a capacity modulation system for scroll compressors of the delayed suction type has been developed in which a valving ring is movably supported on the non-orbiting scroll member. An actuating piston is provided which operates to rotate the valving ring relative to the non-orbiting scroll member to thereby selectively open and close one or more vent passages which communicate with selective ones of the moving fluid pockets to thereby vent the pockets to suction. A scroll-type compressor incorporating this type of capacity modulation system is disclosed in U.S. Pat. Nos. 5,678,985 and 6,123,517, the disclosures of which are incorporated by reference. In these capacity modulation systems, the actuating piston is operated by fluid pressure controlled by a solenoid valve. In one version of this design, the solenoid valve and fluid pressure supply and vent lines are positioned externally of the compressor shell. In another version of this design, the solenoid valve is positioned externally of the compressor shell, but the fluid pressure supply and vent lines are positioned internally of the compressor shell.

The object of this invention is to solve the dilemma between demand limit control and the comfort and reliability of the system. The above-discussed capacity modulated systems provide a two-step scroll compressor that can be unloaded to operate at approximately 65% of capacity using a solenoid mechanism. This solenoid mechanism can be activated by the room thermostat directly or it can be activated by a system control module. The low-capacity state, while being referred to as approximately 65%, can actually be designed to be a different percentage if desired. The solenoid is capable of being "switched on the fly" reliably, thus offering continuous capacity control between the low-capacity (i.e., 65%) and full capacity (100%) by pulse width modulation control thereby providing a good balance between peak demand reduction and comfort.

The control solution of the present invention consists of a two-step compressor with its integral unloading solenoid and a Pulse Width Modulated (PWM) control module with software logic which controls the duty-cycle of the solenoid based on an external utility communication signal, a thermostat signal and the outdoor ambient temperature. The duty-cycle can also be controlled based on a load sensor, which can be either a temperature, a pressure, a voltage sensor or a current sensor located within the A/C system which provides an indication of the max-load operating condition of the compressor. The compressor motor remains energized continuously during the duty cycling of the solenoid. Additionally, the evaporator and condenser fan speeds can also be reduced accordingly in proportion to the compressor duty cycle to maximize comfort and system sufficiency.

Additional advantages and features of the present invention will become apparent from the subsequent description and the appended claims taken in conjunction with the accompanying drawings.

BRIEF DESCRIPTION OF THE DRAWINGS

In the drawings which illustrate the best mode presently contemplated for carrying out the present invention:

FIG. 12 is an enlarged section view of the solenoid valve assembly incorporated in the compressor of FIG. 1;

FIG. 13 is a view similar to that of FIG. 12 but showing a modified solenoid valve assembly;

DETAILED DESCRIPTION OF THE PREFERRED EMBODIMENT

Figure 1:
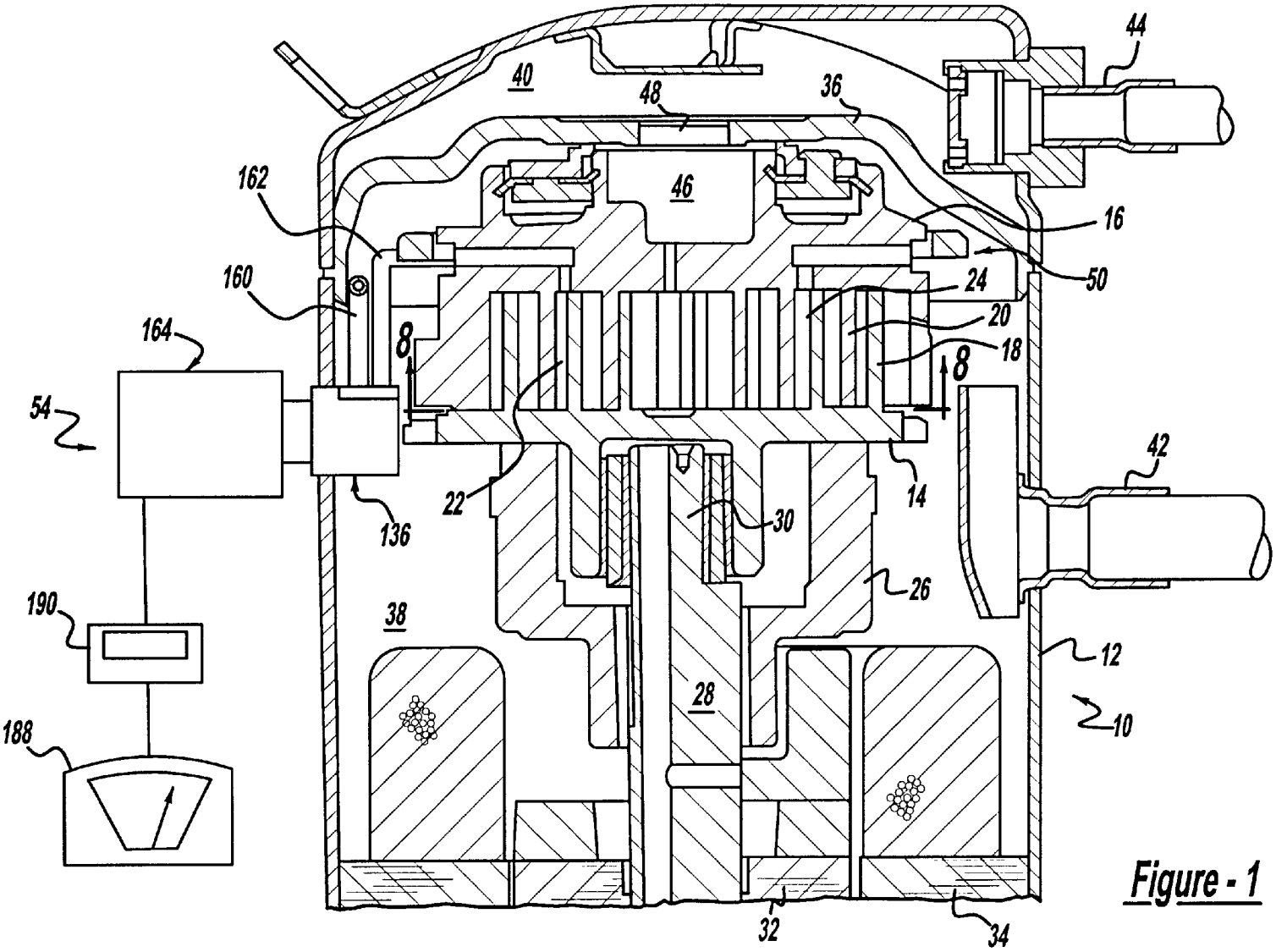
FIG. 1 is a fragmentary section view of a scroll-type compressor incorporating the continuous capacity modulation system of the present invention.

Referring now to the drawings in which like reference numerals designate like or corresponding parts throughout the several views, there is shown in FIG. 1, a hermatic refrigeration compressor of the scroll type indicated generally at 10 incorporating a continuous capacity modulation system in accordance with the present invention.

Compressor 10 is generally of the type disclosed in U.S. Pat. No. 4,767,293 issued Aug. 30, 1988 and assigned to the same assignee as the present application the disclosure of which is hereby incorporated by reference. Compressor 10 includes a hermetically sealed outer shell 12 within which is disposed orbiting and non-orbiting scroll members 14 and 16 each of which include upstanding interleaved spiral wraps 18 and 20 which define moving fluid pockets 22, 24 which progressively decrease in size as they move inwardly from the outer periphery of the scroll members 14 and 16.

A main bearing housing 26 is provided which is supported by outer shell 12 and which in turn movably supports orbiting scroll member 14 for relative orbital movement with respect to non-orbiting scroll member 16. Non-orbiting scroll member 16 is supported by and secured to main bearing housing 26 for limited axial movement with respect thereto in a suitable manner such as disclosed in U.S. Pat. No. 5,407,335 issued Apr. 18, 1995 and assigned to the same assignee as the present application, the disclosure of which is hereby incorporated by reference.

A drive shaft 28 is rotatably supported by main bearing housing 26 and includes an eccentric pin 30 at the upper end thereof drivingly connected to orbiting scroll member 14. A motor rotor 32 is secured to the lower end of drive shaft 28 and cooperates with a stator 34 supported by outer shell 12 to rotatably drive shaft 28.

Outer shell 12 includes a muffler plate 36 which divides the interior thereof into a first lower chamber 38 at substantially suction pressure and an upper chamber 40 at discharge pressure. A suction inlet 42 is provided opening into lower chamber 38 for supplying refrigerant for compression and a discharge outlet 44 is provided from discharge chamber 40 to direct compressed refrigerant to the refrigeration system.

As thus far described, scroll compressor 12 is typical of such scroll-type refrigeration compressors. In operation, suction gas directed to lower chamber 38 via suction inlet 42 is drawn into the moving fluid pockets 22 and 24 as orbiting scroll member 14 orbits with respect to non-orbiting scroll member 16. As the moving fluid pockets 22 and 24 move inwardly, this suction gas is compressed and subsequently discharged into discharge chamber 40 via a center discharge passage 46 in non-orbiting scroll member 16 and discharge opening 48 in muffler plate 36. Compressed refrigerant is then supplied to the refrigeration system via discharge outlet 44.

In selecting a refrigeration compressor for a particular application, one would normally choose a compressor having sufficient capacity to provide adequate refrigerant flow for the most adverse operating conditions to be anticipated for that application and may select a slightly larger capacity to provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worst case" operating conditions, compressor 10 is provided with a continuous capacity modulation system. The continuous capacity modulation system allows the compressor to meet the limit controls and load shedding that have been demanded by the utility summer peak requirements.

The continuous capacity modulation system includes an annular valving ring 50 movably mounted on non-orbiting scroll member 16, an actuating assembly 52 supported within shell 12 and a control system 54 for controlling operation of the actuating assembly.

As best seen with reference to FIGS. 2 and 5 through 7, valving ring 50 comprises a generally circularly shaped main body portion 56 having a pair of substantially diametrically opposed radially inwardly extending protrusions 58 and 60 provided thereon of substantially identical predetermined axial and circumferential dimensions. Suitable substantially identical circumferentially extending guide surfaces 62, 64 and 66, 68 are provided adjacent axially opposite sides of protrusions 58 and 60, respectively. Additionally, two pairs of substantially identical circumferentially extending axially spaced guide surfaces 70, 72 and 74, 76 are provided on main body 56 being positioned in substantially diametrically opposed relationship to each other and spaced circumferentially approximately 90° from respective protrusions 58 and 60. As shown, guide surfaces 72 and 74 project radially inwardly slightly from main body 56 as do guide surfaces 62 and 66. Preferably, guide surfaces 72, 74 and 62, 66 are all axially aligned and lie along the periphery of a circle of a radius slightly less than the radius of main body 56. Similarly, guide surfaces 70 and 76 project radially inwardly slightly from main body 56 as do guide surfaces 64 and 68 with which they are preferably axially aligned. Also surfaces 70, 76 and 64, 68 lie along the periphery of a circle of a radius slightly less than the radius of main body 56 and preferably substantially equal to the radius of the circle along which surfaces 72, 74 and 62, 66 lie. Main body 56 also includes a circumferentially extending stepped portion 78 which includes an axially extending circumferentially facing stop surface 79 at one end. Step portion 78 is positioned between protrusion 60 and guide surfaces 70, 72. A pin member 80 is also provided extending axially upwardly adjacent one end of stepped portion 78. Valving ring 50 may be fabricated from a suitable metal such as aluminum or alternatively may be formed from a suitable polymeric composition and pin 80 may be either pressed into a suitable opening provided therein or integrally formed therewith.

Figure 3:
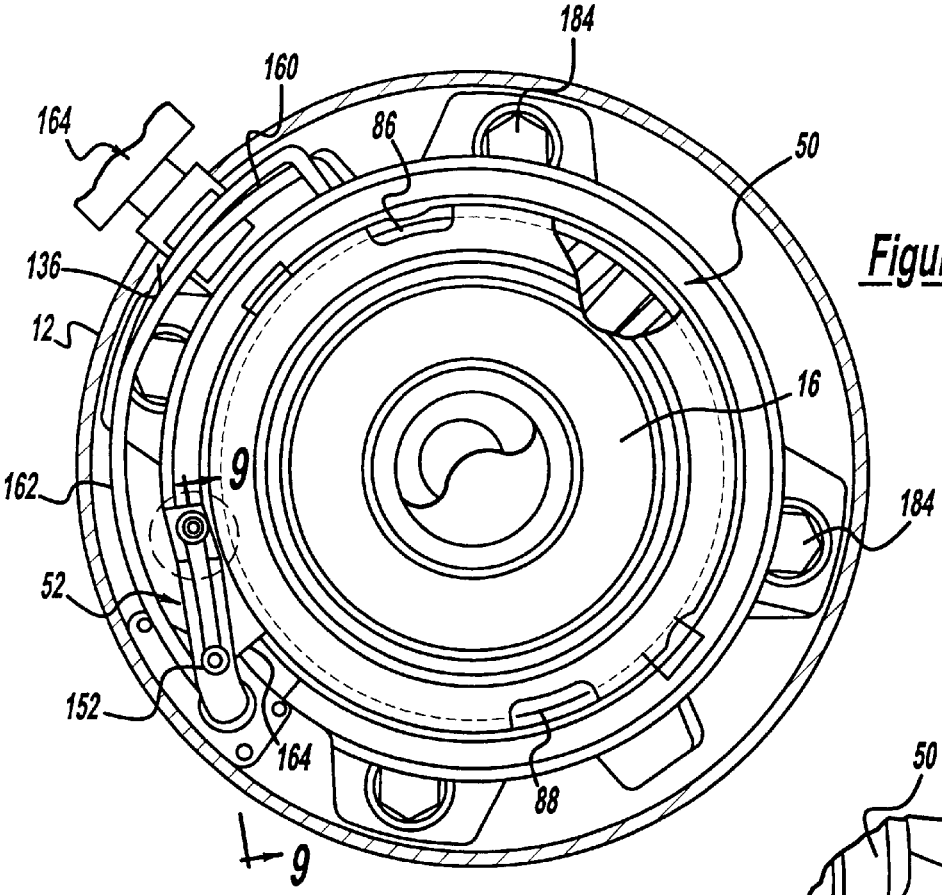
FIG. 3 is a plan view of the compressor shown in FIG. 1 with the top portion of the outer shell removed.

As previously mentioned, valving ring 50 is designed to be movably mounted on non-orbiting scroll member 16. In order to accommodate valving ring 50, non-orbiting scroll member 16 includes a radially outwardly facing cylindrical sidewall portion 82 thereon having an annular groove 84 formed therein adjacent the upper end thereof. In order to enable valving ring 50 to be assembled to non-orbiting scroll member 16, a pair of diametrically opposed substantially identical radially inwardly extending notches 86 and 88 are provided in non-orbiting scroll member 16 each opening into groove 84 as best seen with reference to FIG. 3. Notches 86 and 88 have a circumferentially extending dimension slightly larger than the circumferential extent of protrusions 58 and 60 on valving ring 50.

Groove 84 is sized to movably accommodate protrusions 58 and 60 when valving ring is assembled thereto and notches 86 and 88 are sized to enable protrusions 58 and 60 to be moved into groove 84. Additionally, cylindrical portion 82 will have a diameter such that guide surfaces 62, 64, 66, 68, 70, 72, 74 and 76 will slidingly support rotary movement of valving ring 50 with respect to non-orbiting scroll member 16.

Non-orbiting scroll member 16 also includes a pair of generally diametrically opposed radially extending passages 90 and 92 opening into the inner surface of groove 84 and extending generally radially inwardly through the end plate of non-orbiting scroll member 16. An axially extending passage 94 places the inner end of passage 90 in fluid communication with moving fluid pocket 22 while a second axially extending passage 96 places the inner end of passage 92 in fluid communication with moving fluid pocket 24. Preferably, passages 94 and 96 will be oval in shape so as to maximize the size of the opening thereof without having a width greater than the width of the wrap of the orbiting scroll member 14. Passage 94 is positioned adjacent an inner sidewall surface of scroll wrap 20 and passage 96 is positioned adjacent an outer sidewall surface of wrap 20. Alternatively passages 94 and 96 may be round if desired however the diameter thereof should be such that the opening does not extend to the radially inner side of the orbiting scroll member 14 as it passes thereover.

Figure 9:
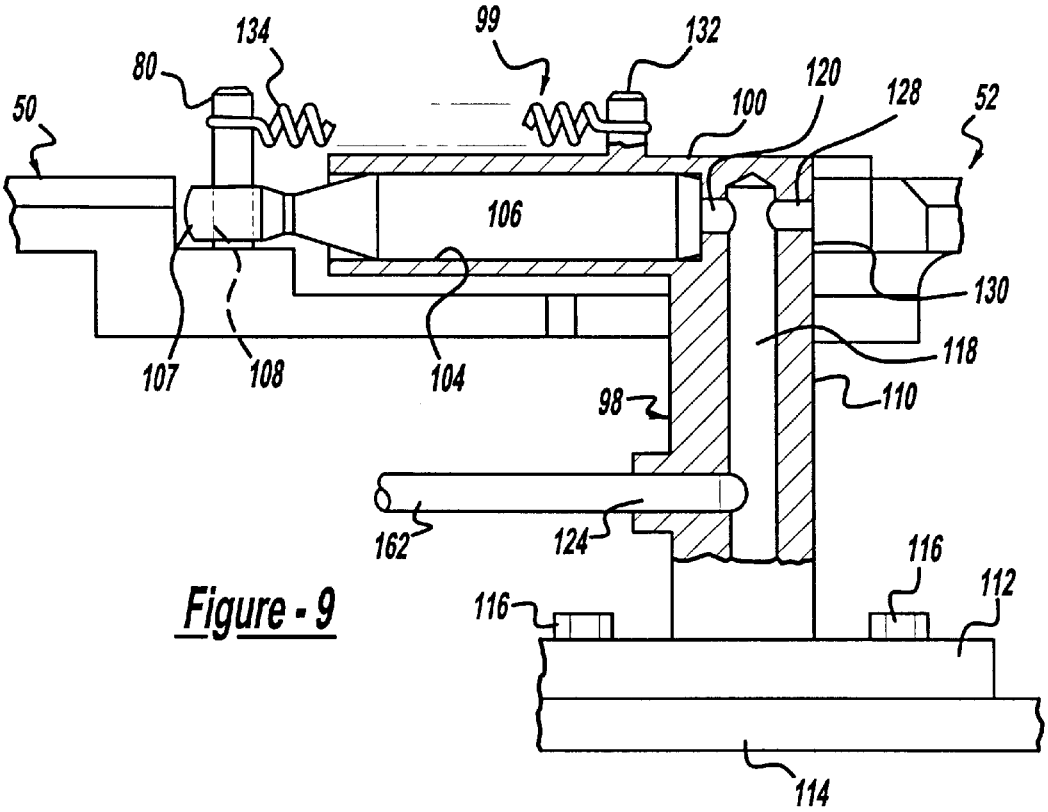
FIG. 9 is an enlarged detailed view of the actuating assembly incorporated in the compressor of FIG. 1.

As best seen with reference to FIG. 9, actuating assembly 52 includes a piston and cylinder assembly 98 and a return spring assembly 99. Piston and cylinder assembly 98 includes a housing 100 having a bore defining a cylinder 104 extending inwardly from one end thereof and within which a piston 106 is movably disposed. An outer end 107 of piston 106 projects axially outwardly from one end of housing 100 and includes an elongated or oval-shaped opening 108 therein adapted to receive pin 80 forming a part of valving ring 50. Elongated or oval opening 108 is designed to accommodate the arcuate movement of pin 80 relative to the linear movement of piston end 107 during operation. A depending portion 110 of housing 100 has secured thereto a suitably sized mounting flange 112 which is adapted to enable housing 100 to be secured to a suitable flange member 114 by bolts 116. Flange 114 is in turn suitably supported within outer shell 12 such as by bearing housing 26.

A passage 118 is provided in depending portion 110 extending upwardly from the lower end thereof and opening into a laterally extending passage 120 which in turn opens into the inner end of cylinder 104. A second laterally extending passage 124 provided in depending portion 110 opens outwardly through the sidewall thereof and communicates at its inner end with passage 118. A second relatively small laterally extending passage 128 extends from fluid passage 118 in the opposite direction of fluid passage 120 and opens outwardly through an end wall 130 of housing 100.

A pin member 132 is provided upstanding from housing 100 to which is connected one end of a return spring 134 the other end of which is connected to an extended portion of pin 80. Return spring 134 will be of such a length and strength as to urge ring 50 and piston 106 into the position shown in FIG. 9 when cylinder 104 is fully vented via passage 128.

Figure 10:
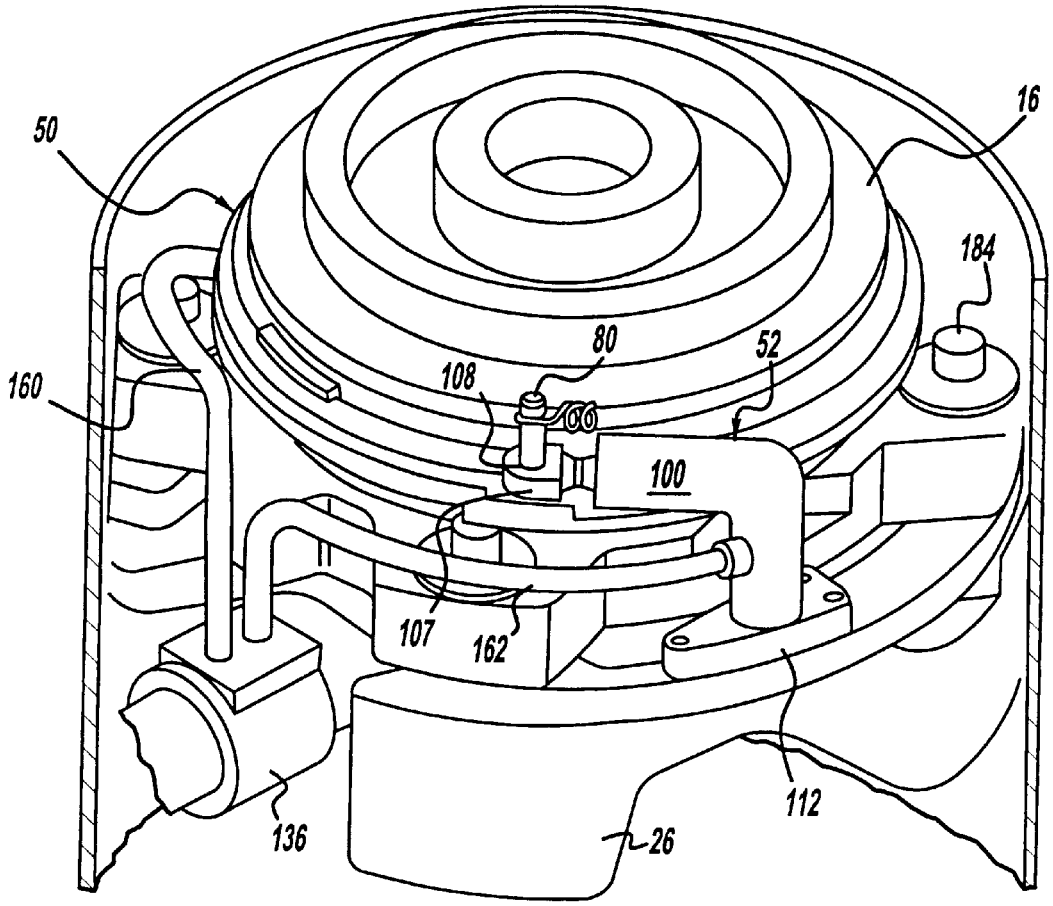
FIG. 10 is a perspective view of the compressor of FIG. 1 with portions of the outer shell broken away.

As best seen with reference to FIGS. 10 and 12, control system 54 includes a valve body 136 having a radially outwardly extending flange 137 including a conical surface 138 on one side thereof. Valve body 136 is inserted into an opening 140 in outer shell 12 and positioned with conical surface 138 abutting the peripheral edge of opening 140 and then welded to shell 12 with cylindrical portion 300 projecting outwardly therefrom. Cylindrical portion 300 of valve body includes an enlarged diameter threaded bore 302 extending axially inwardly and opening into a recessed area 154.

Valve body 136 includes a housing 142 having a first passage 144 extending downwardly from a substantially flat upper surface 146 and intersecting a second laterally extending passage 148 which opens outwardly into the area of opening 140 in shell 12. A third passage 150 also extends downwardly from surface 146 and intersects a fourth laterally extending passage 152 which also opens outwardly into a recessed area 154 provided in the end portion of body 136.

A manifold 156 is sealingly secured to surface 146 by means of suitable fasteners and includes fittings for connection of one end of each of fluid lines 160 and 162 so as to place them in sealed fluid communication with respective passages 150 and 144.

A solenoid coil assembly 164 is designed to be sealingly secured to valve body 136 and includes an elongated tubular member 304 having a threaded fitting 306 sealingly secured to the open end thereof. Threaded fitting 306 is adapted to be threadedly received within bore 302 and sealed thereto by means of 0-ring 308. A plunger 168 is movably disposed within tubular member 304 and is biased outwardly therefrom by spring 174 which bears against closed end 308 of tubular member 304. A valve member 176 is provided on the outer end of plunger 168 and cooperates with valve seat 178 to selectively close off passage 148. A solenoid coil 172 is positioned on tubular member 304 and secured thereto by means of nut 310 threaded on the outer end of tubular member 304.

Figure 11:
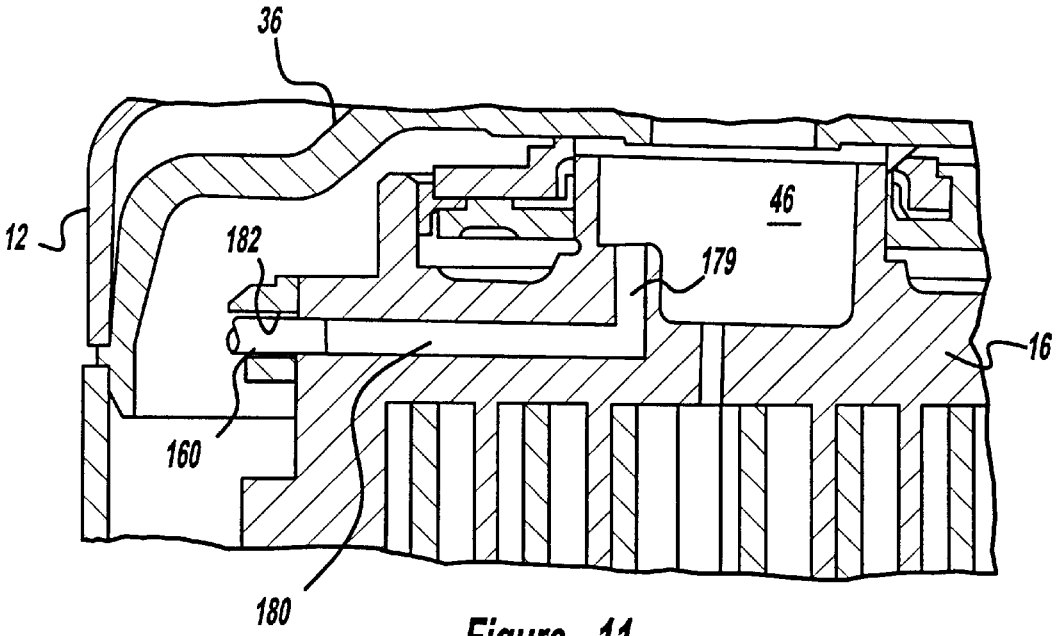
FIG. 11 is a fragmentary section view of the compressor of FIG. 1 showing the pressurized fluid supply passages provided in the non-orbiting scroll.

In order to supply pressurized fluid to actuating assembly 52, an axially extending passage 179 extends downwardly from discharge port 46 and connects to a generally radially extending passage 180 in non-orbiting scroll member 16. Passage 180 extends radially and opens outwardly through the circumferential sidewall of non-orbiting scroll 16 as best seen with reference to FIG. 11. The other end of fluid line 160 is sealingly connected to passage 180 whereby a supply of compressed fluid may be supplied from discharge port 46 to valve body 136. A circumferentially elongated opening 182 is provided In valving ring 50 suitably positioned so as to enable fluid line 160 to pass therethrough while accommodating the rotational movement of ring 50 with respect to non-orbiting scroll member 16.

In order to supply pressurized fluid from valve body 136 to actuating piston and cylinder assembly 98, fluid line 162 extends from valve body 136 and is connected to passage 124 provided in depending portion 110 of housing 100.

Valving ring 50 may be easily assembled to non-orbiting scroll member 16 by merely aligning protrusions 58 and 60 with respective notches 86 and 88 and moving protrusions 58 and 60 into annular groove 84. Thereafter valving ring 50 is rotated into the desired position with the axially upper and lower surfaces of protrusions 58 and 60 cooperating with guide surfaces 62, 64, 66, 68, 70, 72, 74 and 76 to movably support valving ring 50 on non-orbiting scroll member 50. Thereafter, housing 100 of actuating assembly 52 may be positioned on mounting flange 114 with piston end 107 receiving pin 80. One end of spring 134 may then be connected to pin 132. Thereafter, the other end of spring 134 may be connected to pin 80 thus completing the assembly process.

Figure 4:
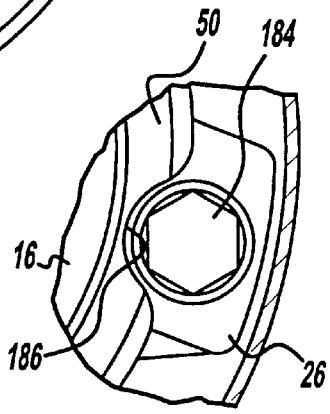
FIG. 4 is an enlarged view showing a portion of a modified valving ring.
Figure 5:
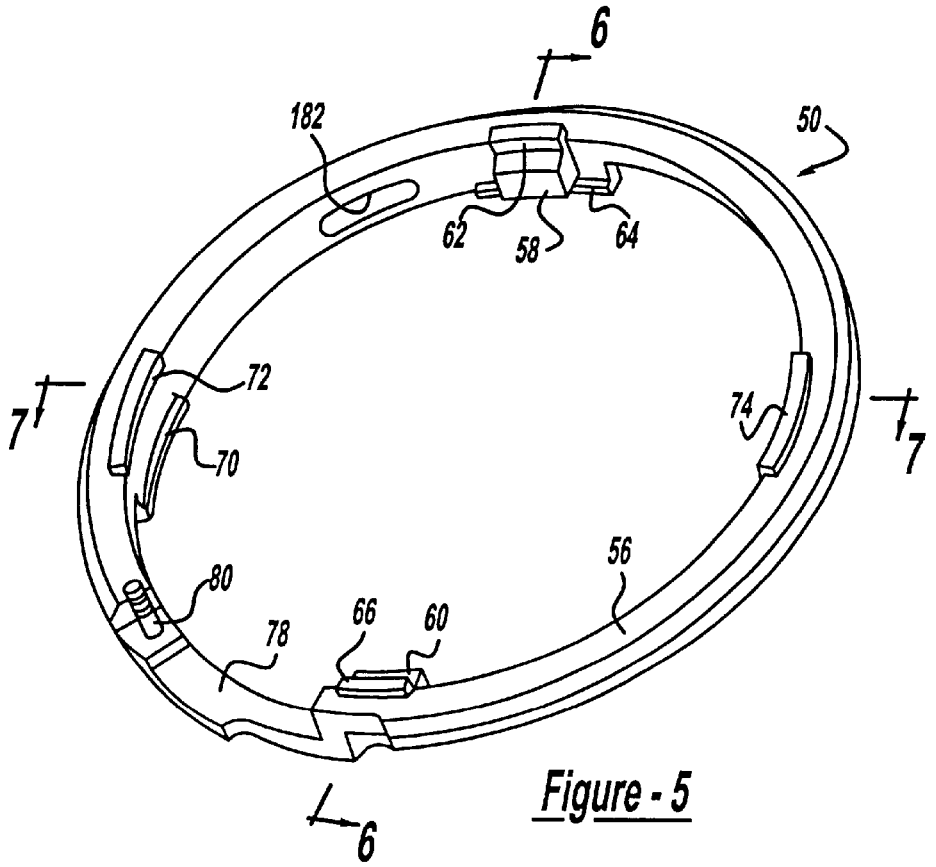
FIG. 5 is a perspective view of the valving ring incorporated in the compressor of FIG. 1.
Figure 6:
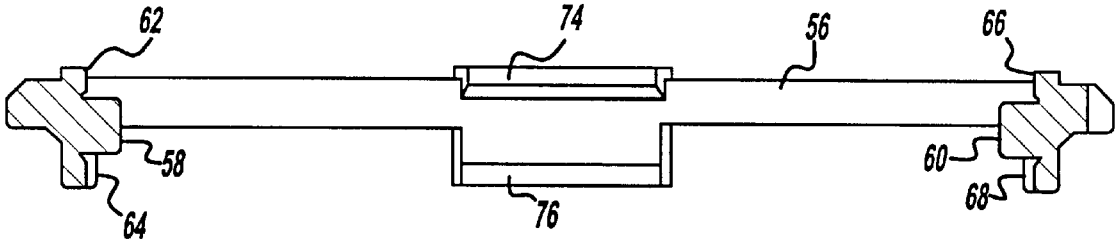
FIGS. 6 and 7 are section views of the valving ring of FIG. 4, the sections being taken along lines 6—6 and 7—7 respectively.
Figure 7:
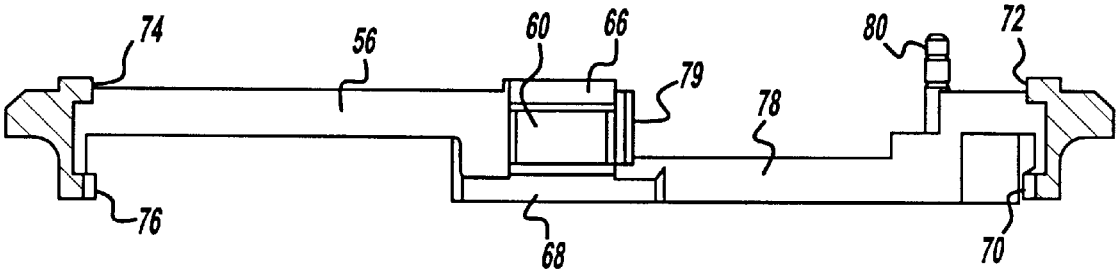
Figure 8:
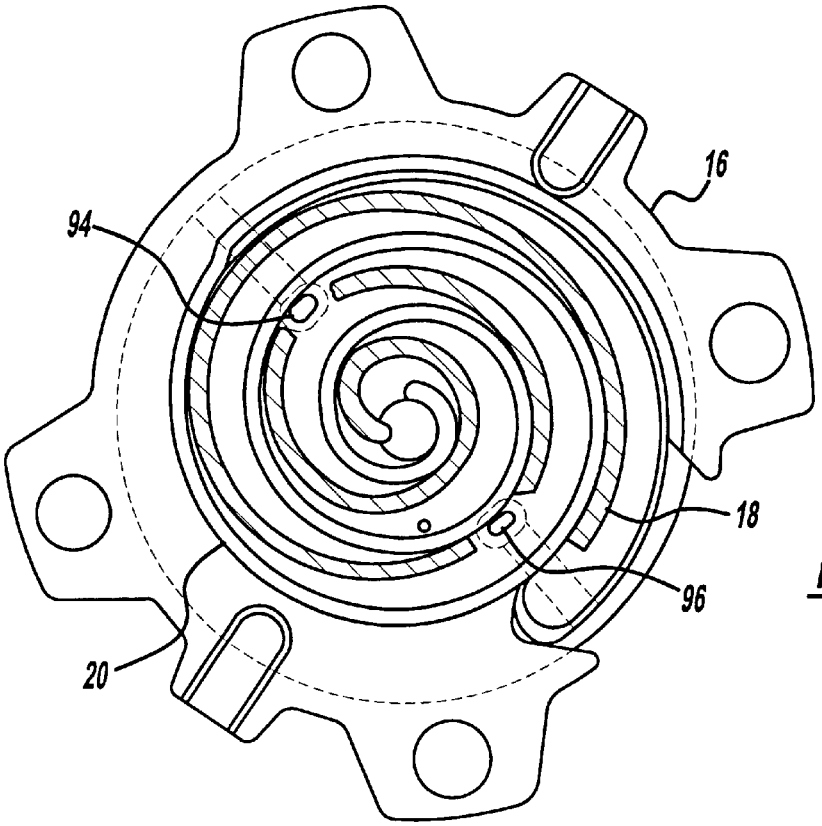
FIG. 8 is a fragmentary section view showing the scroll assembly forming a part of the compressor of FIG. 1, the section being taken along line 8—8 thereof.

While non-orbiting scroll member 16 is typically secured to main bearing housing 26 by suitable bolts 184 prior to assembly of valving ring 50, it may in some cases be preferable to assemble this continuous capacity modulation component to non-orbiting scroll member 16 prior to assembly of non-orbiting scroll member 16 to main bearing housing 26. This may be easily accomplished by merely providing a plurality of suitably positioned arcuate cutouts 186 along the periphery of valving ring 50 as shown in FIG. 4. These cutouts will afford access to securing bolts 184 with valving ring assembled to non-orbiting scroll member 16.

In operation, when system operating conditions as sensed by one or more sensors 188 indicate that full capacity of compressor is required, an indoor unit control module 190 will operate in response to a signal from sensors 188 to energize solenoid coil 172 of solenoid assembly 164 thereby causing plunger 168 to be moved out of engagement with valve seat 178 thereby placing passages 148 and 152 in fluid communication. Pressurized fluid at substantially discharge pressure will then be allowed to flow from discharge port 46 to cylinder 104 via passages 179, 180, fluid line 160, passages 150, 152, 148, 144, fluid line 162 and passages 124, 118 and 120. This fluid pressure will then cause piston 106 to move outwardly with respect to cylinder 104 thereby rotating valving ring so as to move protrusions 58 and 60 into sealing overlying relationship to passages 90 and 92. This will then prevent suction gas drawn into the moving fluid pockets defined by interengaging scroll members 14 and 16 from being exhausted or vented through passages 90 and 92.

When the load conditions change to the point that the full capacity of compressor 10 is not required, sensors 188 will provide a signal indicative thereof to controller 190 which in turn will deenergize coil 172 of solenoid assembly 164. Plunger 168 will then move outwardly from tubular member 304 under the biasing action of spring 174 thereby moving valve 176 into sealing engagement with seat 178 thus closing off passage 148 and the flow of pressurized fluid therethrough. It is noted that recess 154 will be in continuous fluid communication with discharge port 46 and hence continuously subject to discharge pressure. This discharge pressure will aid in biasing valve 176 into fluid tight sealing engagement with valve seat 178 as well as retaining same in such relationship.

The pressurized gas contained in cylinder 104 will bleed back into chamber 38 via vent passage 128 thereby enabling spring 134 to rotate valving ring 50 back to a position in which passages 90 and 92 are no longer closed off by protrusions 58 and 60. Spring 134 will also move piston 106 inwardly with respect to cylinder 104. In this position a portion of the suction gas being drawn into the moving fluid pockets defined by the interengaging scroll members 14 and 16 will be exhausted or vented through passages 90 and 92 until such time as the moving fluid pockets have moved out of communication with ports 94 and 96 thus reducing the volume of the suction gas being compressed and hence the capacity of the compressor. It should be noted that by arranging the modulation system such that compressor 10 is normally in a reduced capacity mode of operation (i.e., solenoid coil is deenergized and hence no fluid pressure is being supplied to the actuating piston cylinder assembly), this system offers the advantage that the compressor will be started in a reduced capacity mode thus requiring a lower starting torque. This enables use of a less costly lower starting torque motor if desired.

Figure 2:
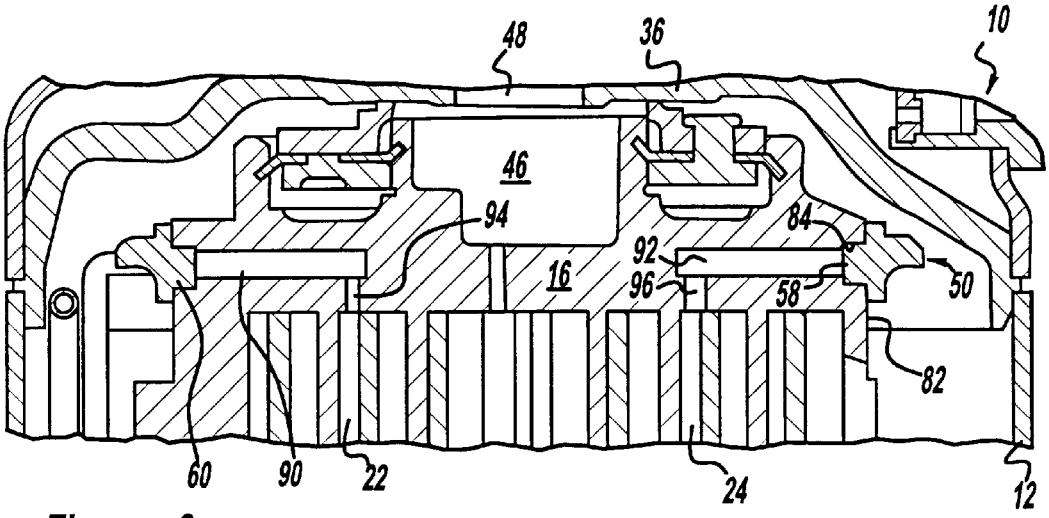
FIG. 2 is a fragmentary view of the compressor of FIG. 1 showing the valving ring in a closed or unmodulated position.

It should be noted that the speed with which the valving ring may be moved between the modulated position of FIG. 1 and the unmodulated position of FIG. 2 will be directly related to the relative size of vent passage 128 and the supply lines. In other words, because passage 128 is continuously open to chamber 38 which is at suction pressure, when coil 172 of solenoid assembly 164 is energized a portion of the pressurized fluid flowing from discharge port 46 will be continuously vented to suction pressure. The volume of this fluid will be controlled by the relative sizing of passage 128. However, as passage 128 is reduced in size, the time required to vent cylinder 104 will increase thus increasing the time required to switch from reduced capacity to full capacity.

Figure 14:
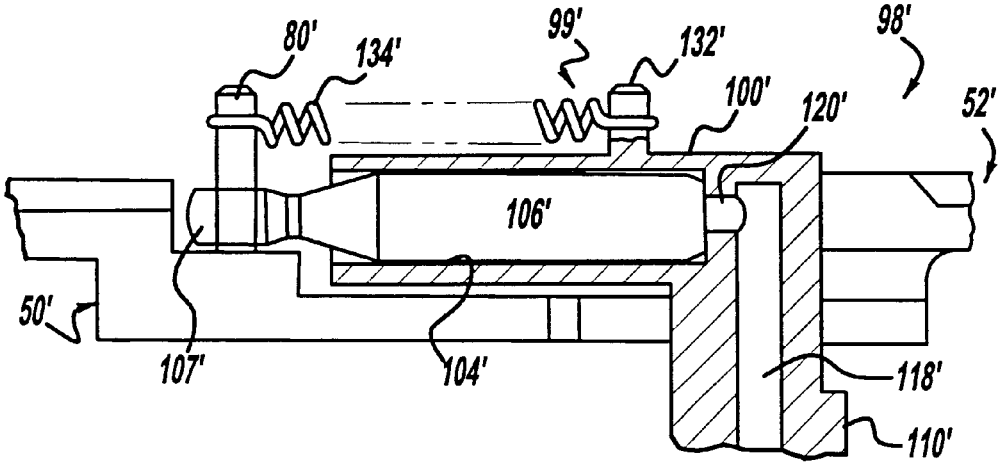
FIG. 14 is a view similar to that of FIG. 9 but showing a modified actuating assembly adapted for use with the solenoid valve assembly of FIG. 13.

While the above embodiment has been described utilizing a passage 128 provided in housing 100 to vent actuating pressure from cylinder 104 to thereby enable compressor 10 to return to reduced capacity, it is also possible to delete passage 128 and incorporate a vent passage in the valve body 136 in place thereof. Such an embodiment is shown in FIGS. 13 and 14. FIG. 13 shows a modified valve body 136' incorporating a vent passage 192 which will operate to continuously vent passage 144' to suction pressure and hence allow cylinder 104 to vent to suction via line 162. FIG. 14 in turn shows a modified piston and cylinder assembly 98' in which vent passage 128 has been deleted. The operation and function of valve body 136' and piston cylinder assembly 98' will otherwise be substantially identical to that disclosed above. Accordingly, corresponding portions of valve bodies 136 and 136' piston and cylinder assemblies 98 and 98' are substantially identical and have each been indicated by the same reference numbers primed.

Figure 15:
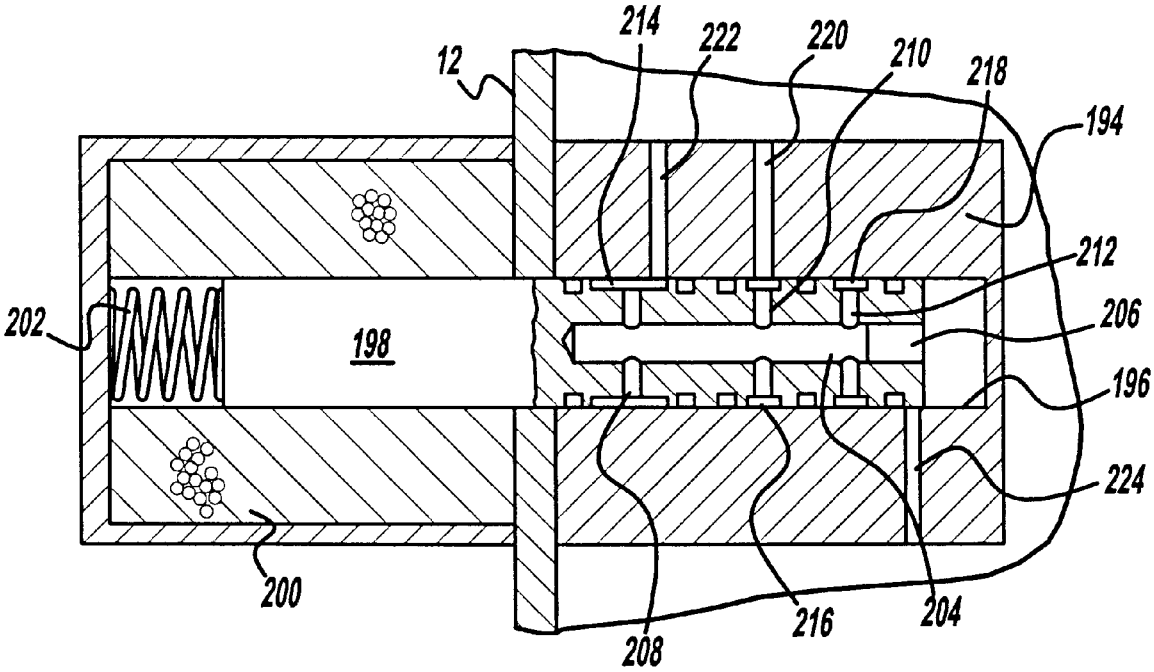
FIG. 15 is a view similar to that of FIGS. 12 and 13 but showing another embodiment of the solenoid valve assembly, all in accordance with the present invention.

While the above embodiments provide efficient relatively low cost arrangements for capacity modulation, it is also possible to utilize a three way solenoid valve in which the venting of cylinder 104 is also controlled by valving. Such an arrangement is illustrated and will be described with reference to FIG. 15. In this embodiment, valve body 194 is secured to shell 12 in the same manner as described above and includes an elongated central bore 196 within which is movably disposed a spool valve 198. Spool valve 198 extends outwardly through shell 12 into solenoid coil 200 and is adapted to be moved longitudinally outwardly from valve body 194 upon energization of solenoid coil 200. A coil spring 202 operates to bias spool valve 198 into valve body 194 when coil 200 is not energized.

Spool valve 198 includes an elongated axially extending central passage 204 the inner end of which is plugged via plug 206. Three groups of generally radially extending axially spaced passages 208, 210, 212 are provided each group consisting of one or more such passages which extend outwardly from central passage 204 with each group opening into axially spaced annular grooves 214, 216 and 218 respectively. Valve body 194 in turn is provided with a first high pressure supply passage 220 which opens into bore 196 and is adapted to be connected to fluid line 160 to supply compressed fluid to valve body 194. A second passage 222 in valve body also opens into bore 196 and is adapted to be connected to fluid line 162 at its outer end to place bore 196 in fluid communication with cylinder 104. A vent passage 224 is also provided in valve body 194 having one end opening into bore 196 with the other end opening into lower chamber 38 of shell 12.

In operation, when solenoid coil is deenergized, spool valve 198 will be in a position such that annular groove 214 will be in open communication with passage 222 and annular groove 218 will be in open communication with vent passage 224 thereby continuously venting cylinder 104. At this time, spool valve 198 will be positioned such that annular seals 226 and 228 will lie on axially opposite sides of passage 220 thereby preventing flow of compressed fluid from discharge port 46. When it is desired to actuate the capacity modulation system to increase the capacity of compressor 10, solenoid coil 200 will be energized thereby causing spool valve 198 to move outwardly from valve body 194. This will result in annular groove 218 moving out of fluid communication with vent passage 224 while annular groove 216 is moved into open communication with high pressure supply passage 220. As passage 222 will remain in fluid communication with annular groove 214 pressurized fluid from passage 220 will be supplied to cylinder 104 via passages 210 and 208 in spool valve 198. Additional suitable axially spaced annular seals will also be provided on spool valve 198 to ensure a sealing relationship between spool valve 198 and bore 196.

The continuous capacity modulation system of the present invention is well suited to enable testing thereof before final welding of the outer shell. In order to accomplish this test, it is only necessary to provide a supply of pressurized fluid to the discharge port 46 and appropriate actuating power to the solenoid coil. Cycling of the solenoid coil will then operate to effect the necessary rotary movement of valving ring thereby providing assurance that all the internal operating components have been properly assembled. The pressurized fluid may be supplied either by operating the compressor to generate same or from an appropriate external source.

Figure 16:
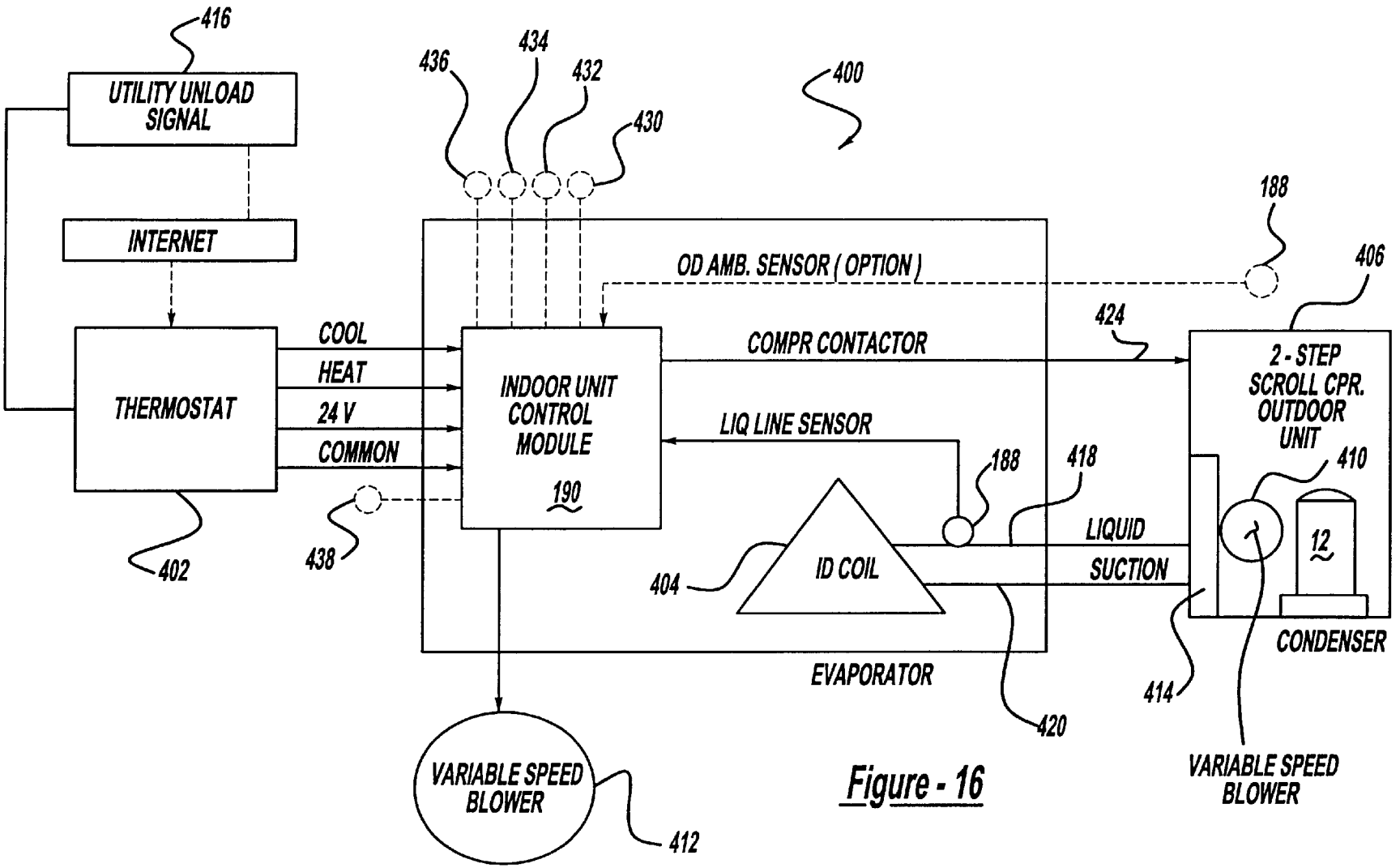
FIG. 16 is a schematic view showing the control architecture for the continuous capacity control system of the present invention.

Referring now to FIG. 16, the control architecture 400 for the present invention is illustrated. Architecture 400 comprises a thermostat 402, indoor unit control module 190, an indoor evaporator coil 404, an outdoor unit 406, temperature sensors 188 and variable speed blowers 410 and 412. Blower 412 is associated with indoor evaporator coil 404 and blower 410 is associated with a condenser coil 414 in outdoor unit 406. As shown in FIG. 16, architecture 400 includes one temperature sensor 188 which monitors the temperature of the liquid refrigerant within the refrigerant line extending between outdoor unit 406 and indoor coil 404 and one temperature sensor 188 which monitors the temperature of outdoor ambient air. Either one or both of these sensors can be utilized by control module 190.

Thermostat 402 is the device which controls the temperature in the room or building. Thermostat 402 is capable of receiving a utility unload signal 416 indication that a load shedding cycle is required. Utility unload signal 416 is optional and when present, thermostat 402 will send this signal to control module 190 for the commencement of the load shedding cycle. In addition to or instead of signal 416, control module 190 can be programmed to begin the load shedding cycle when any of sensors 188 read in excess of a predetermined temperature.

Indoor coil 404 is part of a typical refrigeration circuit which includes scroll compressor 12 which is located within outdoor unit 406. A pair of refrigerant lines 418 and 420 extend between indoor coil 404 and scroll compressor 12 of outdoor unit 406. Line 418 is a liquid delivery line which delivers liquid refrigerant to indoor coil 404 and line 420 is a suction refrigerant line which delivers refrigerant from indoor coil 404. One of sensors 188 monitors the temperature of the refrigerant within line 418.

Outdoor unit 406 comprises scroll compressor 12, condenser 414 and blower 410 associated with condensor 414.

Control module 190 operates scroll compressor 12 at its maximum capacity until it receives a signal to begin load shedding. This signal can come from utility unload signal 416, it can come from outdoor ambient sensor 188 when the outdoor temperature exceeds a pre-selected temperature, preferably 100° F. or this signal can come from liquid line sensor 188 when the temperature of liquid within line 418 exceeds a projected temperature, preferably 105° F.

When the load shedding signal is received, control module 190 switches variable speed blower 412 to a lower speed, preferably 70% air flow and signals scroll compressor 12 to pulse between its full capacity (100%) and its reduced capacity, preferably 65%, through a communication line 424. In addition to reducing the speed for evaporator blower 412, the condenser fan speed for variable speed blower 410 can also be reduced accordingly in proportion to the compressor duty cycle to maximize comfort and system efficiency if desired. It has been found that by utilizing a 45% duty cycle at 40 second cycle time (i.e., 18 seconds on and 22 seconds off) provides approximately a 20% system capacity and power reduction. While the above preferred system has been described with a compressor which cycles between 100% and 65%, the compressor can cycle between other capacities if desired. For example, a compressor designed with both vapor injection and delayed suction capacity modulation can be designed to function at 120% with vapor injection, at 100% without vapor injection and 65% with delayed suction capacity modulation. Control module 190 can be programmed to cycle continuously between any of these capacities. Also, while the above system has been described with sensors 188 which monitor refrigerant temperature and outdoor ambient temperature, other sensors which are capable of determining the max-load operating condition of the system can be utilized. These include, but are not limited to, load sensors 430 which monitor pressure, load sensors 432 which monitor voltage, load sensors 434 which monitor electrical current, condensing coil midpoint temperature sensor 436 or temperature sensors 438 which monitor the temperature of the motor winding of compressor 12 within the air conditioning system.

Additional options available for control module 190 would be to utilize an adaptive strategy with variable cycle times such as 10–30 seconds based on room thermostat error versus set point and/or possibly outdoor ambient. This adaptive method would balance more effectively comfort versus peak demand reduction and optimum solenoid cycling life. With the advent of the Internet-based communication, it is now possible to easily receive the utility signal by Internet. Thus, several houses or appliances within one house can be synchronized out-of-phase to achieve overall utility-site demand loading without any noticeable comfort degradation in each house or in the individual house.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. An air conditioning system comprising:

a scroll compressor including two scroll members having intermeshing wraps, said compressor being selectively operable between a minimum capacity and a high capacity, said minimum capacity being smaller than said high capacity and greater than zero capacity; and a controller in communication with said compressor, said controller being operable to cycle said compressor between said minimum capacity and said high capacity in response to an external utility load-shedding control signal.

2. The air conditioning system in accordance with claim 1, further comprising a sensor connected to said controller which senses a condition indicative of said compressor operating at a max-load capacity.

3. The air conditioning system in accordance with claim 1, wherein said air conditioning system further comprises a pressure sensor connected to said controller.

4. The air conditioning system in accordance with claim 1, wherein said air conditioning system further comprises a temperature sensor connected to said controller.

5. The air conditioning system in accordance with claim 4, wherein said condition is a temperature of refrigerant in said air conditioning system.

6. The air conditioning system in accordance with claim 5, wherein said air conditioning system further comprises an indoor coil and said temperature of said refrigerant is a temperature of refrigerant in a line between said compressor and said indoor coil.

7. The air conditioning system in accordance with claim 5, wherein said air conditioning system further comprises an indoor coil and an outdoor coil, said temperature of said refrigerant being a temperature of refrigerant in a line between said indoor coil and said outdoor coil.

8. The air conditioning system in accordance with claim 5, wherein said air conditioning system further comprises a condenser, said temperature of said refrigerant being a temperature of refrigerant in said condenser.

9. The air conditioning system in accordance with claim 4, wherein said condition is a temperature of ambient air.

10. The air conditioning system in accordance with claim 4, wherein said air conditioning system further comprises a motor having motor windings, said condition being a temperature of said motor windings.

11. The air conditioning system in accordance with claim 1, wherein said air conditioning system further comprises an Internet connection, said external utility signal being provided through said Internet connection.

12. The air conditioning system in accordance with claim 1, wherein said air conditioning system further comprises a thermostat connected to said controller, said external utility signal being provided to said thermostat.

13. The air conditioning system in accordance with claim 1, wherein said cycling of said compressor between said minimum capacity and said high capacity occurs on a fixed cycle time.

14. The air conditioning system in accordance with claim 13, wherein said fixed cycle time is equal to or less than sixty seconds.

15. The air conditioning system in accordance with claim 1, wherein said cycling of said compressor between said minimum capacity and said high capacity occurs on a variable cycle time.

16. The air conditioning system in accordance with claim 15, wherein said controller monitors an operating condition and compares said operating condition to a set point to determine an error value, said variable cycle time being determined adaptively based on said value.

17. The air conditioning system in accordance with claim 1, wherein said air conditioning system further comprises a blower motor, said controller reducing the speed of said blower motor simultaneously with said cycling of said compressor.

18. The air conditioning system in accordance with claim 17, wherein said air conditioning system further comprises an evaporator, said blower motor being associated with said evaporator.

19. The air conditioning system in accordance with claim 17, wherein said air conditioning system further comprises a condenser, said blower motor being associated with said condenser.

20. The air conditioning system in accordance with claim 1, wherein said air conditioning system further comprises a first blower motor associated with an evaporator and a second blower motor associated with a condenser, said controller reducing the speed of said first and second blower motors simultaneous with said cycling of said compressor.

21. The air conditioning system in accordance with claim 1, wherein said air conditioning system further comprises a solenoid valve responsive to said controller for switching said compressor between said high capacity and said minimum capacity.

22. The air conditioning system in accordance with claim 21, wherein pulse width modulation is used to cycle said compressor.

23. The air conditioning system in accordance with claim 1, wherein pulse width modulation is used to cycle said compressor.

24. The air conditioning system in accordance with claim 1, wherein said air conditioning system further comprises a load sensor which monitors refrigerant pressure, said control signal being provided in part by said load sensor.

25. The air conditioning system in accordance with claim 1, wherein said air conditioning system further comprises a load sensor which monitors voltage of said compressor, said control signal being provided by said load sensor.

26. The air conditioning system in accordance with claim 1, wherein said air conditioning system further comprises a load sensor which monitors electrical current being supplied to said compressor, said control signal being supplied by said load sensor.

27. An air conditioning system comprising:

a scroll compressor including two scroll members having intermeshing wraps to define at least two moving fluid pockets, said compressor being selectively operable between a low capacity and a high capacity;

a first fluid passage communicating between one of said at least two moving fluid pockets and an area at substantially suction pressure;

a second fluid passage communicating between a second of said at least two moving fluid pockets and an area at substantially suction pressure;

a solenoid valve operative to substantially simultaneously open and close said first and second fluid passages for cycling said compressor between said low capacity and said high capacity; and a controller in communication with said solenoid valve, said controller being operable to control said solenoid valve using pulse width modulation to continuously cycle said compressor between said low capacity and said high capacity in response to a control signal.

28. The air conditioning system in accordance with claim 27, further comprising a sensor connected to said controller which senses a condition indicative of said compressor operating at a max-load capacity.

29. The air conditioning system in accordance with claim 27, wherein said air conditioning system further comprises a pressure sensor connected to said controller.

30. The air conditioning system in accordance with claim 27, wherein said air conditioning system further comprises a temperature sensor connected to said controller.

31. The air conditioning system in accordance with claim 30, wherein said condition is a temperature of ambient air.

32. The air conditioning system in accordance with claim 27, wherein said cycling of said compressor between said minimum capacity and said high capacity occurs on a fixed cycle time.

33. The air conditioning system in accordance with claim 32, wherein said fixed cycle time is equal to or less than sixty seconds.

34. An air conditioning system comprising:

a scroll compressor including two scroll members having intermeshing wraps, said compressor being selectively operable between a low capacity and a high capacity;

a solenoid valve in communication with said compressor for cycling said compressor between said low capacity and said high capacity; and a controller in communication with said solenoid valve, said controller being operable to control said solenoid valve using pulse width modulation to continuously cycle said compressor between said low capacity and said high capacity in response to a control signal; and a temperature sensor connected to said controller to sense a temperature of refrigerant in the air conditioning system.

35. The air conditioning system in accordance with claim 34, wherein said air conditioning system further comprises an indoor coil and said temperature of said refrigerant is a temperature of refrigerant in a line between said compressor and said indoor coil.

36. The air conditioning system in accordance with claim 34, wherein said air conditioning system further comprises an indoor coil and an outdoor coil, said temperature of said refrigerant being a temperature of refrigerant in a line between said indoor coil and said outdoor coil.

37. The air conditioning system in accordance with claim 34, wherein said air conditioning system further comprises a condenser, said temperature of said refrigerant being a temperature of refrigerant in said condenser.

38. An air conditioning system comprising:

a scroll compressor including a motor and two scroll members, said motor including motor windings and said scroll members having intermeshing wraps, said compressor being selectively operable between a low capacity and a high capacity;

a solenoid valve in communication with said compressor for cycling said compressor between said low capacity and said high capacity; and a controller in communication with said solenoid valve, said controller being operable to control said solenoid valve using pulse width modulation to continuously cycle said compressor between said low capacity and said high capacity in response to a control signal; and a temperature sensor connected to said controller to sense a temperature of said motor windings.

39. An air conditioning system comprising:

a scroll compressor including two scroll members having intermeshing wraps, said compressor being selectively operable between a low capacity and a high capacity;

a solenoid valve in communication with said compressor for cycling said compressor between said low capacity and said high capacity; and a controller in communication with said solenoid valve, said controller being operable to control said solenoid valve using pulse width modulation to continuously cycle said compressor between said low capacity and said high capacity in response to an external utility load-shedding control signal.

40. The air conditioning system in accordance with claim 39, wherein said air conditioning system further comprises an Internet connection, said external utility signal being provided through said Internet connection.

41. The air conditioning system in accordance with claim 39, wherein said air conditioning system further comprises a thermostat connected to said controller, said external utility signal being provided to said thermostat.

42. An air conditioning system comprising:

a scroll compressor including two scroll members having intermeshing wraps, said compressor being selectively operable between a low capacity and a high capacity;

a solenoid valve in communication with said compressor for cycling said compressor between said low capacity and said high capacity on a variable cycle time; and a controller in communication with said solenoid valve, said controller being operable to control said solenoid valve using pulse width modulation to continuously cycle said compressor between said low capacity and said high capacity in response to a control signal.

43. The air conditioning system in accordance with claim 42, wherein said controller monitors an operating condition and compares said operating condition to a set point to determine an error value, said variable cycle time being determined adaptively based on said value.

44. An air conditioning system comprising:

a scroll compressor including two scroll members having intermeshing wraps, said compressor being selectively operable between a low capacity and a high capacity;

a solenoid valve in communication with said compressor for cycling said compressor between said low capacity and said high capacity;

a controller in communication with said solenoid valve, said controller being operable to control said solenoid valve using pulse width modulation to continuously cycle said compressor between said low capacity and said high capacity in response to a control signal; and a blower motor, said controller reducing the speed of said blower motor simultaneously with said cycling of said compressor.

45. The air conditioning system in accordance with claim 44, wherein said air conditioning system further comprises an evaporator, said blower motor being associated with said evaporator.

46. The air conditioning system in accordance with claim 44, wherein said air conditioning system further comprises a condenser, said blower motor being associated with said condenser.

47. An air conditioning system comprising:

a scroll compressor including two scroll members having intermeshing wraps, said compressor being selectively operable between a low capacity and a high capacity;

a solenoid valve in communication with said compressor for cycling said compressor between said low capacity and said high capacity;

a controller in communication with said solenoid valve, said controller being operable to control said solenoid valve using pulse width modulation to continuously cycle said compressor between said low capacity and said high capacity in response to a control signal; and a first blower motor associated with an evaporator and a second blower motor associated with a condenser, said controller reducing the speed of said first and second blower motors simultaneous with said cycling of said compressor.

48. A capacity modulation system for a scroll compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

a first fluid passage communicating between one of said at least two moving fluid pockets and an area at substantially suction pressure;

a second fluid passage communicating between a second of said at least two moving fluid pockets and an area at substantially suction pressure;

a single valve member operative to substantially simultaneously open and close said first and second fluid passages to thereby modulate the capacity of said scroll compressor; and a controller in communication with said valve, said controller being operable to control said valve using pulse width modulation to continuously cycle said compressor between a low capacity and a high capacity in response to a control signal.

49. The capacity modulation system in accordance with claim 48, wherein said controller is operable to cycle said compressor between said low capacity and said high capacity in response to an external utility load-shedding control signal.

50. The capacity modulation system in accordance with claim 48, wherein said cycling of said compressor between said low capacity and said high capacity occurs on a fixed cycle time.

51. The capacity modulation system in accordance with claim 50,wherein said fixed cycle time is equal to or less than sixty seconds.

52. The capacity modulation system in accordance with claim 48,wherein said cycling of said compressor between said low capacity and said high capacity occurs on a variable cycle time.

53. The capacity modulation system in accordance with claim 52, wherein said controller monitors an operating condition and compares said operating condition to a set point to determine an error value, said variable cycle time being determined adaptively based on said value.

* * * * *

UNITED STATES PATENT AND TRADEMARK OFFICE

CERTIFICATE OF CORRECTION

PATENT NO. : 6,412,293 B1
DATED : July 2, 2002
INVENTOR(S) : Hung M. Pham and Jean-Luc Caillat It is certified that error appears in the above-identified patent and that said Letters Patent is hereby corrected as shown below:

Column 2,
Line 12, after “control” insert -- , --.

Column 6,
Line 36, “0-ring” should be -- O-ring --.
Line 55, “In” should be -- in --.

Column 8,
Line 37, after “136” insert -- and --.

Column 12,
Line 21, “simultaneous” should be -- simultaneously --.

Column 15,
Line 7, “simultaneous” should be -- simultaneously --.

Signed and Sealed this

Ninth Day of March, 2004

JON W. DUDAS
*Acting Director of the United States Patent and Trademark Office*